US008502757B2

(12) United States Patent
Liu et al.

(10) Patent No.: US 8,502,757 B2
(45) Date of Patent: Aug. 6, 2013

(54) ORGANIC LIGHT EMITTING DISPLAY HAVING THRESHOLD VOLTAGE COMPENSATION MECHANISM AND DRIVING METHOD THEREOF

(75) Inventors: Chun-Yen Liu, Hsin-Chu (TW); Chia-Yuan Yeh, Hsin-Chu (TW); Cheng-Chieh Tseng, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 100 days.

(21) Appl. No.: 13/296,238

(22) Filed: Nov. 15, 2011

(65) Prior Publication Data

US 2012/0235972 A1 Sep. 20, 2012

(30) Foreign Application Priority Data

Mar. 17, 2011 (TW) ..... 100109157 A

(51) Int. Cl.
*G09G 5/00* (2006.01)
*G09G 3/30* (2006.01)

(52) U.S. Cl.
USPC ..... 345/82; 345/76

(58) Field of Classification Search
USPC ..... 345/82, 83, 39, 76, 211; 315/169.1, 315/169.3
See application file for complete search history.

(56) References Cited

U.S. PATENT DOCUMENTS

| | | | | |
|---|---|---|---|---|
| 7,038,392 | B2 | 5/2006 | Libsch | |
| 7,317,435 | B2 * | 1/2008 | Hsueh | 345/82 |
| 7,411,571 | B2 * | 8/2008 | Huh | 345/80 |
| 7,773,054 | B2 | 8/2010 | Jeong | |
| 7,843,442 | B2 * | 11/2010 | Choi et al. | 345/204 |
| 2007/0024541 | A1 * | 2/2007 | Ryu et al. | 345/76 |
| 2007/0024543 | A1 * | 2/2007 | Chung et al. | 345/76 |

* cited by examiner

*Primary Examiner* — Chanh Nguyen
*Assistant Examiner* — Thang Nguyen
(74) *Attorney, Agent, or Firm* — Winston Hsu; Scott Margo

(57) ABSTRACT

An organic light emitting display (OLED) includes a voltage adjustment unit for adjusting a preliminary control voltage according to a second reference voltage, a couple unit for coupling a change of the preliminary control voltage to adjust a control voltage, a driving unit for providing a driving current and a driving voltage according to the control voltage, a first reset unit for resetting the driving voltage according to a first reference voltage, a second reset unit for resetting the control voltage according to the driving voltage, an organic light emitting diode for generating output light according to the driving current, and an emission enable unit for providing a control of furnishing the driving current to the organic light emitting diode. Through the circuit operation of the reset units and the voltage adjustment unit, occurrences of image retention phenomenon and pixel brightness distortion on the OLED screen can be avoided.

21 Claims, 4 Drawing Sheets

ORGANIC LIGHT EMITTING DISPLAY HAVING THRESHOLD VOLTAGE COMPENSATION MECHANISM AND DRIVING METHOD THEREOF

BACKGROUND

1. Technical Field

The disclosure relates to an organic light emitting display, and more particularly, to an organic light emitting display having threshold voltage compensation mechanism and driving method thereof.

2. Description of the Related Art

Because flat panel displays (FPDs) have advantages of thin appearance, low power consumption, and low radiation, various kinds of flat panel displays have been developed and widely applied in a variety of electronic products such as computer monitors, mobile phones, personal digital assistants (PDAs), or flat panel televisions. Among them, active matrix organic light emitting displays (AMOLEDs) have gained more and more attention due to further advantages of self-emitting light source, high brightness, high emission rate, high contrast, fast reaction, wide viewing angle, and extensive range of working temperature.

FIG. 1 is a structure diagram schematically showing a prior-art active matrix organic light emitting display 100. As shown in FIG. 1, the active matrix organic light emitting display 100 comprises a scan driving circuit 110, a data driving circuit 120, and a plurality of pixel units 150. Each pixel unit 150 includes an input transistor 151, a driving transistor 152, a storage capacitor 153, and an organic light emitting diode 154. The scan driving circuit 110 and the data driving circuit 120 are utilized for providing plural scan signals and plural data signals respectively. Each pixel unit 150 is employed to control a driving current Id based on corresponding scan and data signals, for controlling the light-emitting operation of one organic light emitting diode 154 disposed therein. However, in the operation of the active matrix organic light emitting display 100, the threshold voltage of the driving transistor 152 has en effect on the driving current Id, and therefore the threshold voltage variation of the driving transistors 152 in the pixel units 150 will cause pixel brightness distortion on the OLED screen, thereby degrading display quality. Besides, the voltage/current hysteresis effect of the driving transistor 152 is likely to incur image retention phenomenon. For instance, if two adjacent pixel units 150 are employed to illustrate a white-color grey level and a black-color grey level respectively in a first frame, and the control voltages Vctr of the two pixel units 150 are both set to one and the same voltage corresponding to a middle grey level between the white-color and black-color grey levels in a second frame following the first frame, the driving currents Id of the two pixel units 150 are then different due to the aforementioned hysteresis effect, which results in edge residual phenomenon.

SUMMARY

In accordance with an embodiment, an organic light emitting display having threshold voltage compensation mechanism is provided. The organic light emitting display comprises a data line for transmitting a data signal, a first scan line for transmitting a first scan signal, a second scan line for transmitting a second scan signal, a transmission line for transmitting an emission signal, an input unit, a voltage adjustment unit, a couple unit, a driving unit, a first reset unit, a second reset unit, an emission enable unit, and an organic light emitting diode.

The input unit, electrically connected to the data line and the first scan line, is utilized for outputting a preliminary control voltage according to the data signal and the first scan signal. The voltage adjustment unit, electrically connected to the transmission line and the input unit, is put in use for adjusting the preliminary control voltage according to the emission signal and a second reference voltage. The couple unit, electrically connected to the input unit and the voltage adjustment unit, is employed to adjust a control voltage through coupling a change of the preliminary control voltage. The driving unit, electrically connected to the couple unit, is used for providing a driving current and a driving voltage according to the control voltage and a power voltage. The first reset unit, electrically connected to the driving unit and the second scan line, is utilized for resetting the driving voltage according to the second scan signal and a first reference voltage. The second reset unit, electrically connected to the driving unit, the first reset unit and the first scan line, is utilized for resetting the control voltage according to the first scan signal and the driving voltage. The emission enable unit, electrically connected to the transmission line, the driving unit and the organic light emitting diode, is employed to provide a control of furnishing the driving current to the organic light emitting diode according to the emission signal. The organic light emitting diode, electrically connected to the emission enable unit, is utilized for generating output light according to the driving current.

In accordance with the embodiment, a driving method for use in the aforementioned organic light emitting display having threshold voltage compensation mechanism is further provided. The driving method comprises providing the first scan signal with a first level to the input unit and the second reset unit, providing the second scan signal with the first level to the first reset unit, providing the emission signal with a second level different from the first level for disabling a voltage adjusting operation of the voltage adjustment unit and disabling a current furnishing operation of the emission enable unit, and providing the data signal to the input unit during a first interval; the input unit outputting the preliminary control voltage according to the data signal and the first scan signal during the first interval; the first reset unit resetting the driving voltage according to the second scan signal and the first reference voltage during the first interval; the second reset unit resetting the control voltage according to the first scan signal and the driving voltage during the first interval; switching the second scan signal from the first level to the second level for disabling a resetting operation of the first reset unit during a second interval following the first interval; the second reset unit and the driving unit performing a threshold voltage compensation operation on the control voltage according to the first scan signal and the power voltage during the second interval; switching the first scan signal from the first level to the second level for disabling a resetting operation of the second reset unit and disabling an inputting operation of the input unit during a third interval following the second interval; switching the emission signal from the second level to the first level during a fourth interval following the third interval; the voltage adjustment unit adjusting the preliminary control voltage according to the emission signal and the second reference voltage during the fourth interval; the couple unit adjusting the control voltage through coupling a change of the preliminary control voltage during the fourth interval; the driving unit providing the driving current according to the control voltage and the power voltage during the fourth interval; the emission enable unit furnishing the driving current to the organic light emitting diode according to the emission signal during the fourth interval; and the organic light emitting diode generating output light according to the driving current during the fourth interval.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, preferred embodiments of the present invention will be described in detail with reference to the accompanying drawings. Here, it is to be noted that the present invention is not limited thereto.

Figure 1:
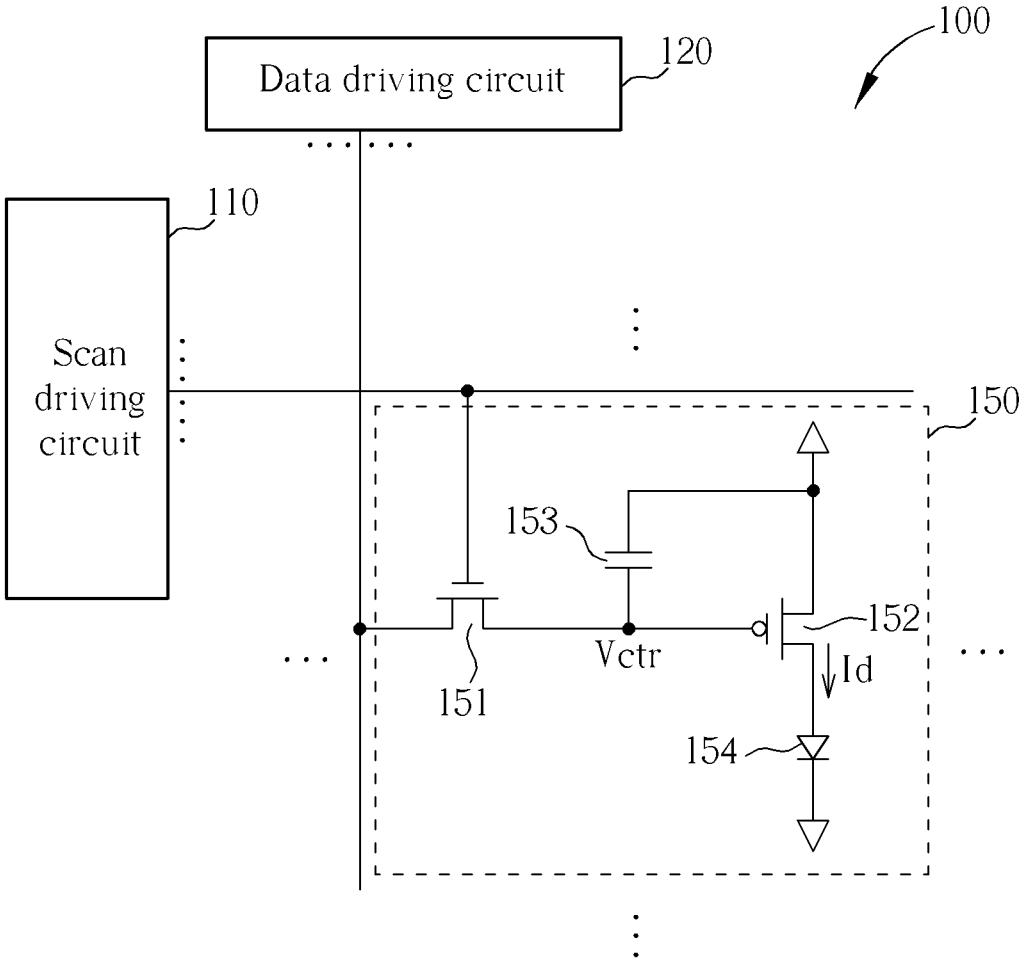
FIG. 1 PRIOR ART
FIG. 1 is a structure diagram schematically showing a prior-art active matrix organic light emitting display.
Figure 2:
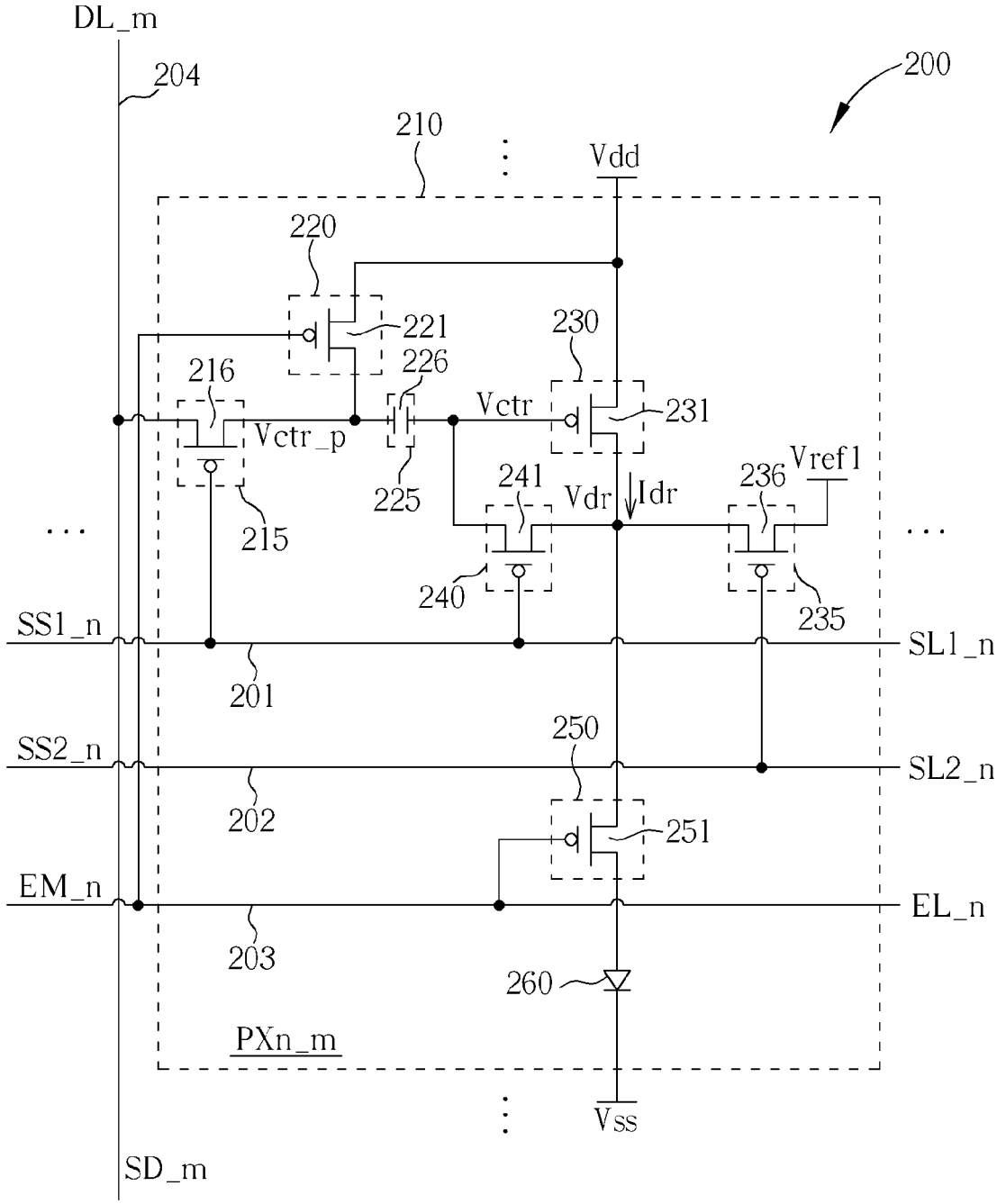
FIG. 2 is a structure diagram schematically showing an organic light emitting display in accordance with a first embodiment.

FIG. 2 is a structure diagram schematically showing an organic light emitting display 200 in accordance with a first embodiment. As shown in FIG. 2, the organic light emitting display 200 comprises a plurality of first scan lines 201, a plurality of second scan lines 202, a plurality of transmission lines 203, a plurality of data lines 204, and a plurality of pixel units 210. The first scan lines 201 include a first scan line SL1_n for transmitting a first scan signal SS1_n, the second scan lines 202 include a second scan line SL2_n for transmitting a second scan signal SS2_n, the transmission lines 203 include a transmission line EL_n for transmitting an emission signal EM_n, the data lines 204 include a data line DL_m for transmitting a data signal SD_m, and the pixel units 210 include a pixel unit PXn_m for performing a light-emitting operation according to the first scan signal SS1_n, the second scan signal SS2_n, the emission signal EM_n and the data signal SD_m. The pixel unit PXn_m includes an input unit 215, a voltage adjustment unit 220, a couple unit 225, a driving unit 230, a first reset unit 235, a second reset unit 240, an emission enable unit 250 and an organic light emitting diode 260.

The input unit 215, electrically connected to the data line DL_m and the first scan line SL1_n, is utilized for outputting a preliminary control voltage Vctr_p according to the data signal SD_m and the first scan signal SS1_n. The voltage adjustment unit 220, electrically connected to the transmission line EL_n and the input unit 215, is put in use for adjusting the preliminary control voltage Vctr_p according to the emission signal EM_n and the first power voltage Vdd. The couple unit 225, electrically connected to the input unit 215 and the voltage adjustment unit 220, is employed to adjust a control voltage Vctr through coupling a change of the preliminary control voltage Vctr_p. The driving unit 230, electrically connected to the couple unit 225, is utilized for providing a driving current Idr and a driving voltage Vdr according to the control voltage Vctr and the first power voltage Vdd. The first reset unit 235, electrically connected to the driving unit 230 and the second scan line SL2_n, is used for resetting the driving voltage Vdr according to the second scan signal SS2_n and a first reference voltage Vref1. The second reset unit 240, electrically connected to the driving unit 230, the first reset unit 235 and the first scan line SL1_n, is used for resetting the control voltage Vctr according to the first scan signal SS1_n and the driving voltage Vdr. The emission enable unit 250, electrically connected to the transmission line EL_n, the driving unit 230 and the organic light emitting diode 260, is utilized for providing a control of furnishing the driving current Idr to the organic light emitting diode 260 according to the emission signal EM_n. The organic light emitting diode 260 is employed to generate output light based on the driving current Idr.

In the embodiment shown in FIG. 2, the input unit 215 comprises a first transistor 216, the couple unit 225 comprises a capacitor 226, the driving unit 230 comprises a second transistor 231, the first reset unit 235 comprises a third transistor 236, the second reset unit 240 comprises a fourth transistor 241, the voltage adjustment unit 220 comprises a fifth transistor 221, the emission enable unit 250 comprises a sixth transistor 251, and the organic light emitting diode 260 comprises an anode electrically connected to the sixth transistor 251 and a cathode for receiving a second power voltage Vss. The first transistor 216 through the sixth transistor 251 may each be a P-type thin film transistor (TFT) or a P-type field effect transistor (FET). In another embodiment, the first transistor 216 and the third transistor 236 to the sixth transistor 251 may each be an N-type thin film transistor or an N-type field effect transistor, and the second transistor 231 may be a P-type thin film transistor or a P-type field effect transistor.

The first transistor 216 comprises a first end electrically connected to the data line DL_m, a gate end electrically connected to the first scan line SL1_n, and a second end electrically connected to the fifth transistor 221 and the capacitor 226. The second transistor 231 comprises a first end for receiving the first power voltage Vdd, a gate end for receiving the control voltage Vctr, and a second end for outputting the driving current Idr and the driving voltage Vdr. The capacitor 226 is electrically connected between the second end of the first transistor 216 and the gate end of the second transistor 231. The third transistor 236 comprises a first end for receiving the first reference voltage Vref1, a gate end electrically connected to the second scan line SL2_n, and a second end electrically connected to the second end of the second transistor 231. The fourth transistor 241 comprises a first end electrically connected to the second end of the second transistor 231, a gate end electrically connected to the first scan line SL1_n, and a second end electrically connected to the gate end of the second transistor 231. It is noted that the second transistor 231 functions as a diode when the fourth transistor 241 is turned on. The fifth transistor 221 comprises a first end for receiving the first power voltage Vdd, a gate end electrically connected to the transmission line EL_n, and a second end electrically connected to the second end of the first transistor 216. The sixth transistor 251 comprises a first end electrically connected to the second end of the second transistor 231, a gate end electrically connected to the transmission line EL_n, and a second end electrically connected to the anode of the organic light emitting diode 260.

Figure 3:
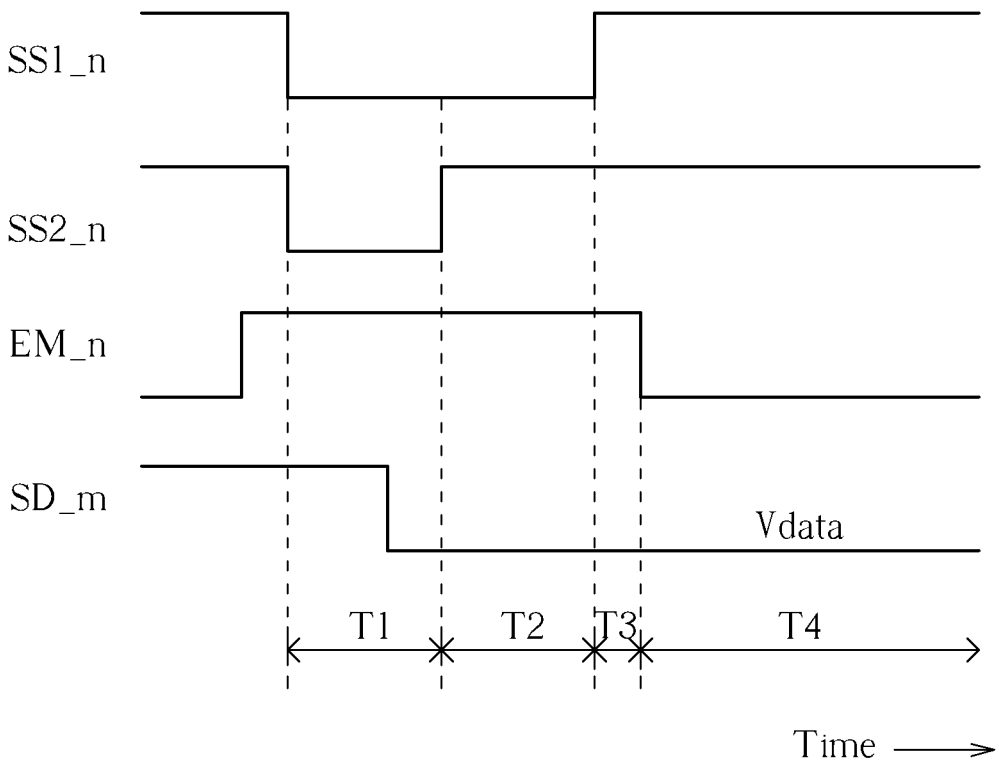
FIG. 3 is a schematic diagram showing related signal waveforms regarding the operation of the organic light emitting display illustrated in FIG. 2 based on a preferred driving method, having time along the abscissa.

FIG. 3 is a schematic diagram showing related signal waveforms regarding the operation of the organic light emitting display 200 illustrated in FIG. 2 based on a preferred driving method, having time along the abscissa. The signal waveforms in FIG. 3, from top to bottom, are the first scan signal SS1_n, the second scan signal SS2_n, the emission signal EM_n, and the data signal SD_m. Referring to FIG. 3 in conjunction with FIG. 2, during a first interval T1, the first scan line SL1_n transmits the first scan signal SS1_n with a first level to the input unit 215 and the second reset unit 240, the second scan line SL2_n transmits the second scan signal SS2_n with the first level to the first reset unit 235, the transmission line EL_n transmits the emission signal EM_n with a second level different from the first level for disabling the voltage adjusting operation of the voltage adjustment unit 220 and disabling the current furnishing operation of the emission enable unit 250, and the data line DL_m transmits the data signal SD_m to the input unit 215. At this time, the input unit 215 outputs the preliminary control voltage Vctr_p according to the data signal SD_m and the first scan signal SS1_n, the first reset unit 235 resets the driving voltage Vdr according to the second scan signal SS2_n and the first reference voltage Vref1, and the second reset unit 240 resets the control voltage Vctr according to the first scan signal SS1_n and the driving voltage Vdr. In view of that, the driving operation of the driving unit 230 is reset for avoiding an occurrence of image retention phenomenon.

During a second interval T2 following the first interval T1, the second scan signal SS2_n is switched from the first level to the second level for disabling the resetting operation of the first reset unit 235. At this time, the second reset unit 240 and the driving unit 230 perform a threshold voltage compensation operation on the control voltage Vctr according to the first scan signal SS1_n and the first power voltage Vdd. After the threshold voltage compensation operation, the control voltage Vctr can be expressed as Formula (1) listed below.

$$Vctr = Vdd - |Vth| \quad \text{Formula (1)}$$

In Formula (1), Vth represents the threshold voltage of the second transistor 231. In one embodiment, the length of the second interval T2 is greater than the length of the first interval T1, such that the threshold voltage compensation operation may be fully performed.

During a third interval T3 following the second interval T2, the first scan signal SS1_n is switched from the first level to the second level for disabling the resetting operation of the second reset unit 240 and disabling the inputting operation of the input unit 215. At this time, the preliminary control voltage Vctr_p is substantially identical to the voltage level Vdata of the data signal SD_m. During a fourth interval T4 following the third interval T3, the emission signal EM_n is switched from the second level to the first level. At this time, the voltage adjustment unit 220 adjusts the preliminary control voltage Vctr_p according to the emission signal EM_n and the first power voltage Vdd, and the couple unit 225 adjusts the control voltage Vctr through coupling the change of the preliminary control voltage Vctr_p. After the voltage adjustment operation, the control voltage Vctr can be expressed as Formula (2) listed below.

$$Vctr = 2Vdd - |Vth| - Vdata \quad \text{Formula (2)}$$

Thereafter, the driving unit 230 provides the driving current Idr according to the control voltage Vctr and the first power voltage Vdd, and the driving current Idr provided can be expressed as Formula (3) listed below.

$$Idr = \frac{\beta}{2}(Vdata - Vdd)^2 \quad \text{Formula (3)}$$

In Formula (3), β represents a proportional constant. At this time, the emission enable unit 250 furnishes the driving current Idr to the organic light emitting diode 260 according to the emission signal EM_n, such that the organic light emitting diode 260 is able to generate output light according to the driving current Idr. It is noted that the driving current Idr is not affected by the threshold voltage Vth of the second transistor 231, and therefore the threshold voltage variation regarding the transistors in the driving units of the pixel units 210 has no effect on pixel brightness, thereby avoiding an occurrence of pixel brightness distortion. That is, through the aforementioned reset and threshold voltage compensation operation, occurrences of image retention phenomenon and pixel brightness distortion on the OLED screen can be avoided, for achieving high image display quality.

It is noted that, in the preferred driving method described above, if the first transistor 216 and the third transistor 236 to the sixth transistor 251 are P-type thin film transistors or P-type field effect transistors, the second level is greater than the first level. Alternatively, if the first transistor 216 and the third transistor 236 to the sixth transistor 251 are N-type thin film transistors or N-type field effect transistors, the first level is greater than the second level.

Figure 4:
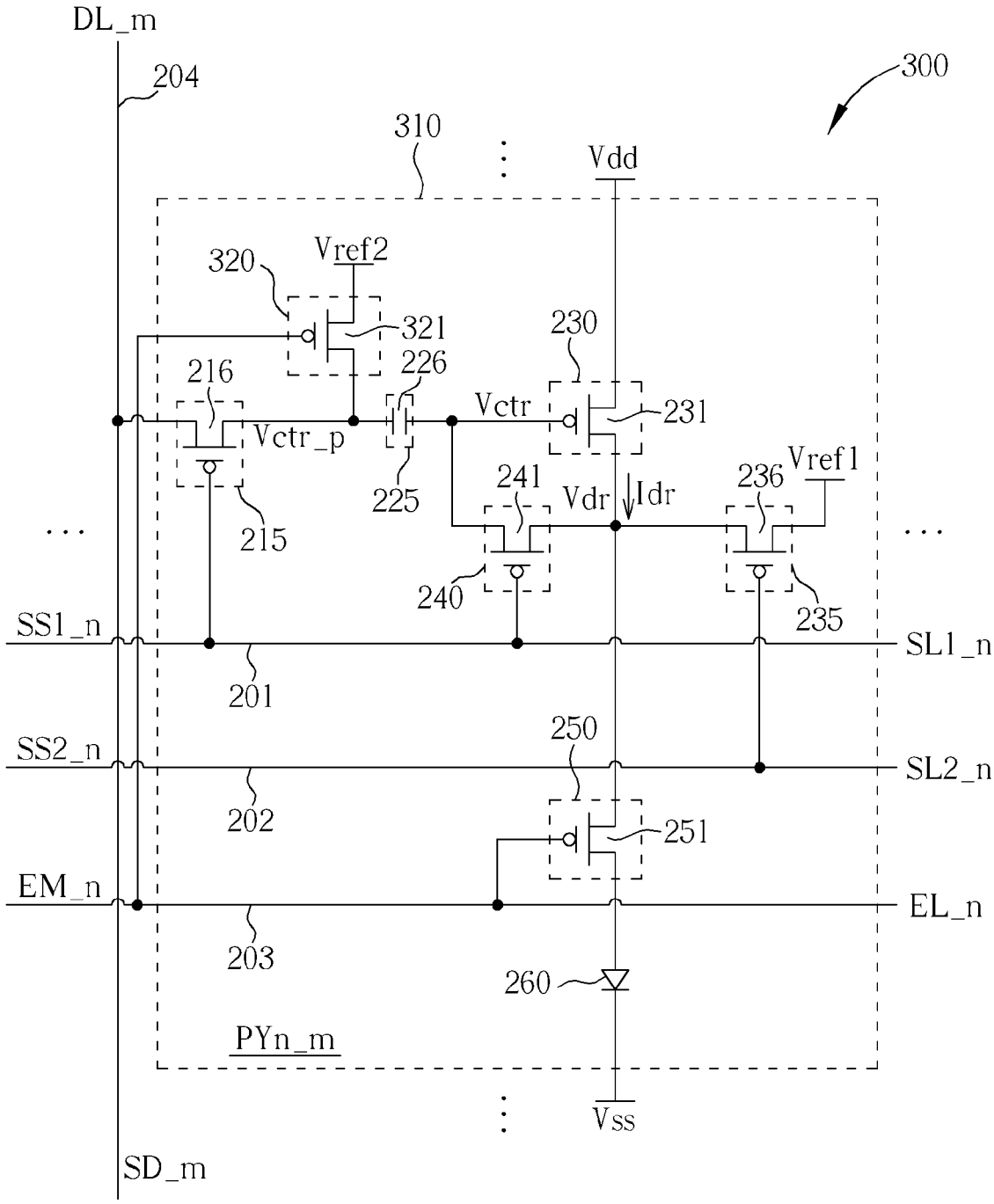
FIG. 4 is a structure diagram schematically showing an organic light emitting display in accordance with a second embodiment.

FIG. 4 is a structure diagram schematically showing an organic light emitting display 300 in accordance with a second embodiment. As shown in FIG. 4, the organic light emitting display 300 is similar to the organic light emitting display 200 shown in FIG. 2, differing in that the pixel units 210 are replaced with a plurality of pixel units 310, wherein the pixel unit PXn_m is replaced with a pixel unit PYn_m. Further, the pixel unit PYn_m is similar to the pixel unit PXn_m, differing primarily in that the voltage adjustment unit 220 is replaced with a voltage adjustment unit 320. The voltage adjustment unit 320, electrically connected to the transmission line EL_n, the input unit 215 and the couple unit 225, is utilized for adjusting the preliminary control voltage Vctr_p according to the emission signal EM_n and a second reference voltage Vref2. In the embodiment shown in FIG. 4, the voltage adjustment unit 320 includes a fifth transistor 321 which may be a thin film transistor or a field effect transistor. The fifth transistor 321 comprises a first end for receiving the second reference voltage Vref2, a gate end electrically connected to the transmission line EL_n, and a second end electrically connected to the second end of the first transistor 216.

In the display operation of the organic light emitting display 300, after the voltage adjustment unit 320 adjusts the preliminary control voltage Vctr_p according to the emission signal EM_n and the second reference voltage Vref2, and the couple unit 225 adjusts the control voltage Vctr through coupling a change of the preliminary control voltage Vctr_p, the control voltage Vctr adjusted can be expressed as Formula (4) listed below.

$$Vctr = Vdd - |Vth| + Vref2 - Vdata \quad \text{Formula (4)}$$

Thereafter, the driving unit 230 provides the driving current Idr according to the control voltage Vctr of Formula (4) and the first power voltage Vdd, and the driving current Idr provided can be expressed as Formula (5) listed below.

$$Idr = \frac{\beta}{2}(Vdata - Vref2)^2 \quad \text{Formula (5)}$$

As shown in Formula (5), neither the threshold voltage Vth of the second transistor 231 nor the first power voltage Vdd has an effect on the driving current Idr. For that reason, the voltage drop occurring to a conductive line for transmitting the first power voltage Vdd has no effect on the driving current Idr, and therefore an occurrence of pixel brightness distortion on the OLED screen due to the trace resistance of aforementioned conductive line can also be avoided, for improving image display quality of large-size display panels.

To sum up, with the aid of the reset and threshold voltage compensation mechanism according to the present invention described above, occurrences of image retention phenomenon and pixel brightness distortion can be avoided in the operation of the organic light emitting display, thereby achieving high image display quality on the OLED screen.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. An organic light emitting display, comprising:

a data line for transmitting a data signal;

a first scan line for transmitting a first scan signal;

a second scan line for transmitting a second scan signal;

a transmission line for transmitting an emission signal;

an input unit, electrically connected to the data line and the first scan line, for outputting a preliminary control voltage according to the data signal and the first scan signal;

a voltage adjustment unit, electrically connected to the transmission line and the input unit, for adjusting the preliminary control voltage according to the emission signal and a second reference voltage;

a couple unit, electrically connected to the input unit and the voltage adjustment unit, for adjusting a control voltage through coupling a change of the preliminary control voltage;

a driving unit, electrically connected to the couple unit, for providing a driving current and a driving voltage according to the control voltage and a first power voltage;

a first reset unit, electrically connected to the driving unit and the second scan line, for resetting the driving voltage according to the second scan signal and a first reference voltage;

a second reset unit, electrically connected to the driving unit, the first reset unit and the first scan line, for resetting the control voltage according to the first scan signal and the driving voltage;

an organic light emitting diode for generating output light according to the driving current; and an emission enable unit, electrically connected to the transmission line, the driving unit and the organic light emitting diode, for providing a control of furnishing the driving current to the organic light emitting diode according to the emission signal.

2. The organic light emitting display of claim 1, wherein the input unit comprises a first transistor, the first transistor having a first end electrically connected to the data line, a gate end electrically connected to the first scan line, and a second end electrically connected to the voltage adjustment unit and the couple unit.

3. The organic light emitting display of claim 2, wherein the first transistor comprises a thin film transistor or a field effect transistor.

4. The organic light emitting display of claim 1, wherein the driving unit comprises a second transistor, the second transistor having a first end for receiving the first power voltage, a gate end for receiving the control voltage, and a second end for outputting the driving current and the driving voltage.

5. The organic light emitting display of claim 4, wherein the second transistor comprises a thin film transistor or a field effect transistor.

6. The organic light emitting display of claim 1, wherein the couple unit comprises a capacitor electrically connected between the input unit and the driving unit.

7. The organic light emitting display of claim 1, wherein the first reset unit comprises a third transistor, the third transistor having a first end for receiving the first reference voltage, a gate end electrically connected to the second scan line, and a second end electrically connected to the driving unit, the second reset unit and the emission enable unit.

8. The organic light emitting display of claim 7, wherein the third transistor comprises a thin film transistor or a field effect transistor.

9. The organic light emitting display of claim 1, wherein the second reset unit comprises a fourth transistor, the fourth transistor having a first end electrically connected to the driving unit, the first reset unit and the emission enable unit, a gate end electrically connected to the first scan line, and a second end electrically connected to the couple unit and the driving unit.

10. The organic light emitting display of claim 9, wherein the fourth transistor comprises a thin film transistor or a field effect transistor.

11. The organic light emitting display of claim 1, wherein the voltage adjustment unit comprises a fifth transistor, the fifth transistor having a first end for receiving the second reference voltage, a gate end electrically connected to the transmission line, and a second end electrically connected to the input unit and the couple unit.

12. The organic light emitting display of claim 11, wherein the fifth transistor comprises a thin film transistor or a field effect transistor.

13. The organic light emitting display of claim 11, wherein the second reference voltage is the first power voltage.

14. The organic light emitting display of claim 1, wherein the emission enable unit comprises a sixth transistor, the sixth transistor having a first end electrically connected to the driving unit, the first reset unit and the second reset unit, a gate end electrically connected to the transmission line, and a second end electrically connected to the organic light emitting diode.

15. The organic light emitting display of claim 14, wherein the sixth transistor comprises a thin film transistor or a field effect transistor.

16. The organic light emitting display of claim 1, wherein the organic light emitting diode comprises an anode electrically connected to the emission enable unit and a cathode for receiving a second power voltage.

17. A driving method, comprising:

outputting a preliminary control voltage by an input unit according to a data signal and a first scan signal;

adjusting the preliminary control voltage by a voltage adjustment unit according to an emission signal and a second reference voltage;

adjusting a control voltage by a couple unit through coupling a change of the preliminary control voltage;

providing a driving current and a driving voltage by a driving unit according to the control voltage and a power voltage;

resetting the driving voltage by a first reset unit according to a second scan signal and a first reference voltage;

resetting the control voltage by a second reset unit according to the first scan signal and the driving voltage;

generating output light by an organic light emitting diode according to the driving current;

providing a control of furnishing the driving current to the organic light emitting diode by an emission enable unit according to the emission signal;

providing the first scan signal with a first level to the input unit and the second reset unit, providing the second scan signal with the first level to the first reset unit, providing the emission signal with a second level different from the first level for disabling a voltage adjusting operation of the voltage adjustment unit and disabling a current furnishing operation of the emission enable unit, and providing the data signal to the input unit during a first interval;

outputting the preliminary control voltage by the input unit according to the data signal and the first scan signal during the first interval;

resetting the driving voltage by the first reset unit according to the second scan signal and the first reference voltage during the first interval;

resetting the control voltage by the second reset unit according to the first scan signal and the driving voltage during the first interval;

switching the second scan signal from the first level to the second level for disabling a resetting operation of the first reset unit during a second interval following the first interval;

performing a threshold voltage compensation operation on the control voltage by the second reset unit and the driving unit according to the first scan signal and the power voltage during the second interval;

switching the first scan signal from the first level to the second level for disabling a resetting operation of the second reset unit and disabling an inputting operation of the input unit during a third interval following the second interval;

switching the emission signal from the second level to the first level during a fourth interval following the third interval;

adjusting the preliminary control voltage by the voltage adjustment unit according to the emission signal and the second reference voltage during the fourth interval;

adjusting the control voltage by the couple unit through coupling a change of the preliminary control voltage during the fourth interval;

providing the driving current by the driving unit according to the control voltage and the power voltage during the fourth interval;

furnishing the driving current to the organic light emitting diode by the emission enable unit according to the emission signal during the fourth interval; and generating output light by the organic light emitting diode according to the driving current during the fourth interval.

18. The driving method of claim 17, wherein the second level is greater than the first level.

19. The driving method of claim 17, wherein the first level is greater than the second level.

20. The driving method of claim 17, wherein the second reference voltage is the power voltage.

21. The driving method of claim 17, wherein a length of the second interval is greater than a length of the first interval.

* * * * *